US006006821A

United States Patent [19]

Haun et al.

[11] Patent Number: 6,006,821

[45] Date of Patent: Dec. 28, 1999

[54] METHOD AND APPARATUS FOR MELTING AND POURING SPECIALTY METALS

[75] Inventors: Robert E. Haun; Robin A. Lampson, both of Ukiah, Calif.

[73] Assignee: Retech Services, Inc., Ukiah, Calif.

[21] Appl. No.: 09/215,631

[22] Filed: Dec. 16, 1998

Related U.S. Application Data

[60] Provisional application No. 60/070,927, Dec. 18, 1997.

[51] Int. Cl.[6] ..... B22D 27/02

[52] U.S. Cl. ..... 164/495; 164/514; 266/200

[58] Field of Search ..... 164/469, 470, 164/495, 496, 497, 508, 509, 513, 514, 515, 506, 494; 266/200; 373/18, 20, 21, 25, 11, 17; 219/121.36, 121.37, 121.43

[56] References Cited

U.S. PATENT DOCUMENTS

| | | | |
|---|---|---|---|
| 2,825,641 | 3/1958 | Beall et al. | 164/495 |
| 3,105,275 | 10/1963 | Hanks | 164/506 |
| 4,538,671 | 9/1985 | Waterstrat | 164/495 |
| 5,174,811 | 12/1992 | Schmidt et al. | 75/610 |
| 5,753,004 | 5/1998 | Hanai et al. | 373/18 |

*Primary Examiner*—Kuang Y. Lin
*Attorney, Agent, or Firm*—Townsend and Townsend and Crew

[57] ABSTRACT

Specialty metals and alloys are melted in a crucible typically holding no more than about 100 lbs. of the metal and disposed in a furnace the interior of which is filled with a desired, e.g. inert, gas and subjected to a vacuum in the range of about 5% to 32% of atmospheric pressure. For special circumstances, it would be possible to start in the specified pressure range and then increase the melt chamber pressure to atmospheric or above. The vacuum permits the initiation and formation of long electric discharge arcs between the electrode of an immovable plasma torch mounted to the furnace and the inside of the crucible to provide enough space for charging of the crucible with fresh metal laterally through a charge opening in the upright side wall of the furnace and a vacuum chamber operatively connected with the charge opening. The melted metal is drained from the crucible through a drain hole in the bottom into molds which typically have close to the desired finished shape of the article and which can be removed from the furnace without the need to break the vacuum therein. A skull forming along the inside surfaces of the crucible is lifted off the crucible surfaces after each pour with a closure plate that is pushed from below into the drain hole. The skull is then melted with the plasma torch so that resulting melted metal collecting in the drain forms a drain plug upon solidification.

23 Claims, 2 Drawing Sheets

METHOD AND APPARATUS FOR MELTING AND POURING SPECIALTY METALS

This application claims benefit of provisional application Ser. No. 60/070,927 filed Dec. 18, 1997.

BACKGROUND OF THE INVENTION

This invention relates to furnaces for and the melting of metals, and alloys of metals ("metals" unless otherwise noted), for treating and/or alloying the metals.

High performance metals, such as titanium, are routinely melted and are treated to give them desired physical and/or chemical characteristics. For example, substantially pure titanium (Ti) and Ti alloys are used for a variety of high performance applications ranging from aircraft turbine rotor blades to golf club heads and beyond. Titanium must be melted at a high temperature while it is being treated, for example to adjust its oxygen content to 0.16–0.18 weight percent of $O_2$ to give it optimal strength. During treatment, care must be exercised to prevent the contamination of the titanium by other substances. This is accomplished by melting it in an inert atmosphere, such as argon, while subjecting it to heat generated, for example, by a plasma torch which forms an electric discharge arc from an electrode of the torch to a molten pool of the metal contained within a cooled metallic crucible in which the metal is located. Other metals are treated according to the type of metal and the characteristic(s) one wishes to attain.

In the past, such metals were melted in relatively large furnaces, holding, for example, as much as 5000 lbs. Such furnaces have a crucible inside a sealed enclosure that is closed with a removable port. When a plasma torch is used as the heat source, it has been movably mounted to the enclosure top surface so that the electrode can be moved towards and away from the bottom of the crucible and can further be swiveled or otherwise moved to deflect it in a lateral direction, for example along a conical path, so that the electric arc and plasma discharge of the torch can be swept over the pool of molten metal in the crucible. Such movably mounted plasma torches provide excellent heating but are expensive to manufacture, install and maintain.

The cost of such torches and manipulators is nevertheless justifiable because relatively large batches of metal can be melted at a time. The pressure within the enclosure is kept relatively high, typically in the order of 250 torr to 860 torr. The torches are axially movable into closer proximity to the crucible surface for striking and maintaining the needed electric arc, because at the prevailing, relatively high pressure in the enclosure, only relatively short arc lengths can be maintained.

The walls of the crucibles in such furnaces are constructed of electrically and thermally highly conductive metal, such as copper, and are usually water-cooled to keep them from melting or contaminating metal being melted. After the treatment, the molten metal is gravitationally drained through consumable ceramic or graphite nozzles into molds located beneath the crucible. The consumable nozzle is typically heated to the melting point of the metal by an auxiliary source such as an induction coil and susceptor.

After the metal has been poured, the plasma torch is turned off, the furnace is permitted to cool, the port or cover is opened, and a skull of the metal that has been melted (a thin metal layer that hardens over the inside surface of the crucible) is removed. Thereafter, the ceramic or graphite nozzle is inspected and replaced if necessary.

Considerable time necessarily elapses between the melting of successive batches of metal because, following each pour, the furnace must cool down sufficiently to permit its opening, the removal of the skull, inspection of the nozzle, and its recharging with a fresh load of metal to be melted. This is acceptable when the metal is melted in large, e.g. 5000 lb., batches. For the same reasons, the high cost of prior art furnaces presented no particular obstacle because of the high price obtainable for specialty metals such as titanium, which in its properly treated and purified state presently yields prices of as much as $6/lb.

However, enterprises which require relatively smaller quantities of such metals, such as the needs of golf club head manufacturers for substantially pure titanium, could not afford to acquire or operate prior art furnaces. In many cases, they have to purchase the material in ingot form. The ingots are remelted and cast into golf club head molds. This is a relatively expensive manufacturing operation and, additionally, generates a great deal of titanium scrap which can be sold at only a fraction of the cost of the ingot price, say in the range of between 60¢–80¢/lb. Material costs therefore heavily contribute to the relatively high cost of such golf clubs.

SUMMARY OF THE INVENTION

A principal object of the present invention is to reduce the material costs for products made of high performance metals, such as, but not limited to, titanium used for certain golf club heads. This is achieved by providing a low-cost furnace that can be economically operated for producing the relatively small quantities of such metals required by certain manufacturers, such as golf club head manufacturers.

Briefly, such a furnace distinguishes itself from the earlier described, prior art, large-scale industrial furnaces by having a relatively small crucible, which, for example, may hold no more than about 100 lbs., and even as little as 50 lbs., of the metal to be melted, e.g. Ti. To achieve low cost, the furnace uses a plasma torch which is fixed; that is, immovably mounted, to the enclosure for the crucible, typically the cover thereof. The furnace is initially operated at a substantial vacuum; that is, at a pressure of about 5% to 32% of atmospheric pressure (about 40–240 torr), so that a relatively long arc can be struck and maintained from the electrode of the torch to the crucible and the metal therein. For special circumstances, it would be possible to start in the specified pressure range and then increase the melt chamber pressure to atmospheric or above.

The attainable longer electric arc lengths further permit lateral access to the crucible in the area between the top thereof and the torch mounted on the top surface of the enclosure. In accordance with the invention, a vacuum-locked transfer chamber can be placed in the available space between the crucible and the torch for charging the crucible with relatively small quantities of metal. The use of the transfer chamber eliminates the need for removing the vacuum from the furnace and cooling it following each pour before charging it with fresh metal. Consequently, the intervals between successive batches in the furnace of the present invention need only be long enough to recharge it with fresh metal. The need for awaiting a sufficient cooling of the furnace to open it, as is the case for prior art furnaces, is eliminated.

While a number of electric arc torch types can be used, the preferred embodiment uses a swirl flow hollow electrode device such as disclosed in U.S. Pat. No. 3,307,011 because of the directional stability inherent in this type.

A DC coil may be placed around the crucible to generate a magnetic field which moves the molten metal in concert with the plasma current, creating a vortex. This assures an even heating and stirring of the metal. The coil is operated to generate a "J cross B force" which, as is well known to those skilled in the art, results in vertical fluid flow of the molten metal.

To enable the successive melting of batches, it is necessary to form the drain hole closing metal plug after each pour. This is done by providing a closure plate located beneath the bottom of the crucible which can be moved horizontally under the hole and which has an upwardly extending boss that closely fits into the hole. The plate is additionally vertically movable to insert the boss into the drain hole, thereby engaging the portion of the skull formed inside the hole and pushing it, together with the remainder of the skull, upwardly. The skull is thereby at least partially separated from the crucible so that it can be melted with the plasma flow without a danger of overheating the crucible walls with the plasma since the furnace wall cannot cool the separated skull. The melted metal of the skull collects in the discharge hole above the boss of the closure plate and, upon cooling (by the preferably water-cooled wall surfaces and closure plate), forms a metal plug which retains the next batch of melted metal in the crucible. This technique of lifting and remelting the skull reduces scrap losses inherent in prior art processing and reduces operational cost by minimizing "down time".

Once the plug has hardened, the closure plate is removed. The molten metal is poured from the crucible, by melting the metal plug. The magnetic coil is used to direct the hot plasma towards the part of the melt pool above the plug to thereby heat and eventually melt it, allowing the melted metal to exit the crucible through the hole or depression formed in the bottom of the skull.

The molds into which the melted metal is poured are arranged beneath the crucible and inside the enclosure. Following pouring, the molds are removed from the enclosure through a vacuum lock chamber so that the vacuum in the enclosure can be maintained at all times.

Thus, even though the furnace, and the method of operating it to melt metal in accordance with the present invention, melts only relatively small batches of such metal, the nonproductive time between batch melts is markedly reduced compared to prior processes, so that significant amounts of metal can be melted on a daily basis. In addition, the relatively low acquisition and operating costs of the furnace of the present invention make it ideally suited for use by concerns which require only small to moderate amounts of metal but which can obtain significant cost savings because the metal can be poured into their ultimate shapes, or shapes close thereto. The subsequent machining of the parts generates little scrap metal, thereby significantly reducing the material costs for articles such as golf club heads.

Additional cost savings are attained by such users because instead of having to purchase ingots made of high-priced material, they can purchase in the open market from third parties the much less expensive scrap and use it for charging their furnaces.

DESCRIPTION OF THE PREFERRED EMBODIMENTS

Figure 1:
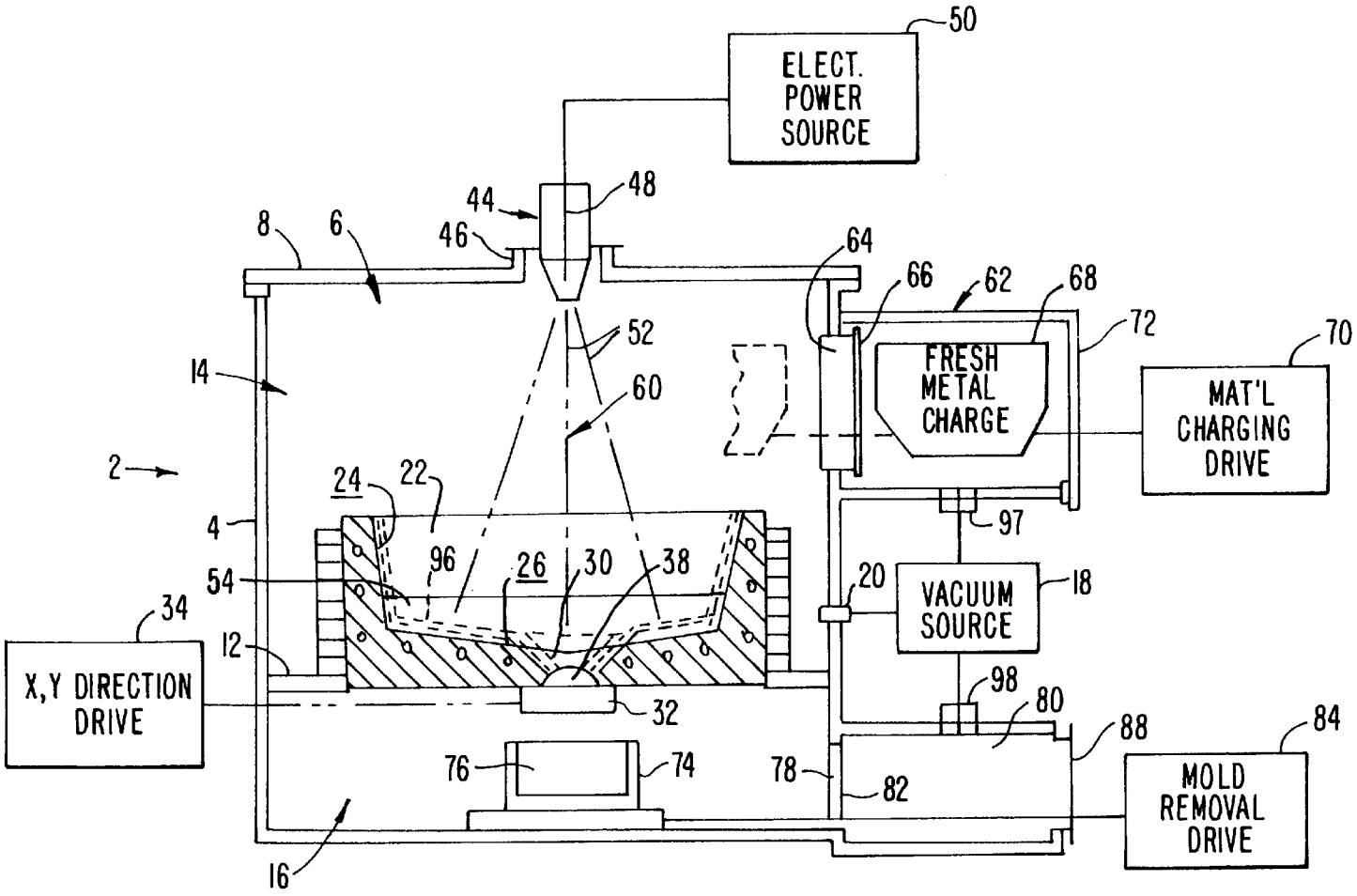
FIG. 1 is a schematic, elevational view, in section, illustrating a furnace constructed in accordance with the present invention for implementing the method of this invention.
Figure 2:
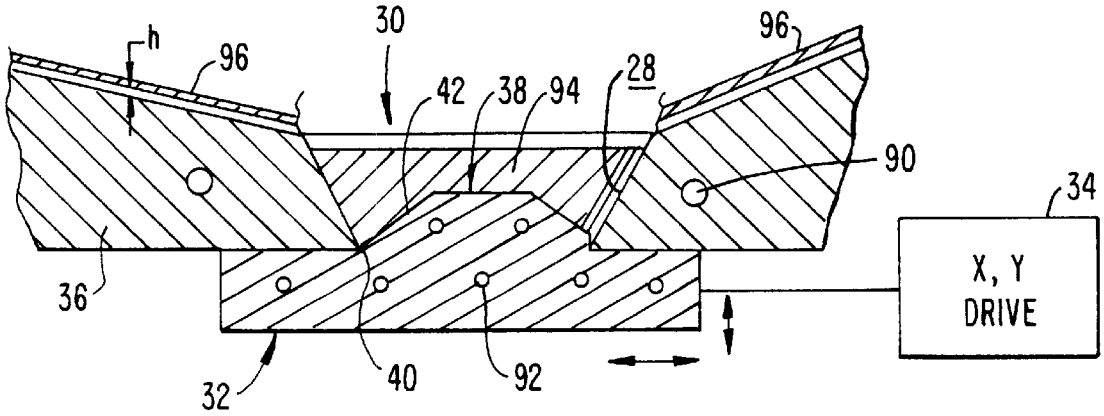
FIG. 2 is a fragmentary, enlarged, cross-sectional view of the area surrounding the drain hole of a crucible located inside the furnace shown in FIG. 1.

Referring to the drawings, a furnace 2 constructed in accordance with the present invention for melting a metal, such as titanium, or a metal alloy, in a crucible 10 has an enclosure 4 that surrounds the crucible and has an open end 6 that is sealingly closed by a cover 8. Support 12 positions the crucible inside the enclosure, dividing the interior thereof into an upper melt section 14 and a lower casting or molding section 16 of the furnace. A vacuum source 18 is fluidly coupled to the interior of the furnace via a vacuum valve 20 and maintains a vacuum preferably in, but not limited to, the range of between about 5% to 32% of atmospheric pressure, or in the range of about 40–240 torr, in the upper part of the enclosure (above support 12).

Crucible 10 is constructed of an electrically and thermally highly conductive material, such as copper, and forms a melting hearth 22. The chamber is defined by an interior surface of the crucible that includes a preferably slightly outwardly tapered upright side wall 24, a bottom surface 26 which slopes slightly downwardly from the side wall towards the center of the crucible, and a downwardly converging, conical surface which defines the wall 28 of a bottom drain hole 30.

A closure plate attached to an X, Y direction drive 34 is located beneath base 36 of the crucible and has a size so that it fully covers, i.e. extends beyond, the drain hole when in alignment therewith. The base plate includes an upwardly extending boss 38 that has a relatively short cylindrical base section 40 and, disposed above it, a frustoconically shaped top 42. The cylindrical base of the boss has a diameter only slightly smaller than the smallest diameter of the drain hole at the lower end thereof. The drain hole is closed by first moving the plate horizontally (X direction) until the boss is aligned with the hole and thereafter vertically (Y direction) so that the frustoconical top of the boss extends into the drain hole and cylindrical base 40 thereof is surrounded by the lower end of the hole.

A plasma torch 44 is fixedly; that is, immovably, mounted on cover 8 and has a forward end that extends through a flange 46 into melt section 14 of the furnace. As is well known, the torch includes an electrode 48 that is connected to a suitable electric power source 50 for generating an electric discharge (arc) from the electrode to the furnace and therewith heating a gas stream which exits the torch and forms a hot plasma flow that is directed onto the surface of a pool 54 of molten metal in the crucible.

The crucible is charged with fresh metal that is to be melted without the need for opening the enclosure or venting the vacuum inside thereof by providing a vacuum chamber which communicates with the melt section 14 of the furnace through a lateral charge opening 64 in the upright wall of the enclosure. The charge opening is located in the portion of the wall above the top surface of the crucible and below cover 8 and, therefore, determines the minimum distance between the crucible and the cover and, therewith, plasma torch 44. For a relatively small crucible capable of melting about 100 lbs. of metal, a minimum spacing between the bottom surface 26 of the crucible and the electrode 48 of plasma torch 44 is typically about 2 inches and in the spacing is preferably in the range of about 8–16 inches, enough so that the entire amount of metal can be placed into the crucible before melting starts. A gate 66 normally sealingly closes the charge opening to prevent fluid communication between the interior of the vacuum chamber and the furnace.

The container can be manually moved into the melt section 14, as is shown in phantom lines, or a metal charging drive 70 is provided therefor. The other end of the vacuum chamber remote from the furnace is open, so that container 68 can be moved in and out of the chamber for filling it with fresh metal (while charge opening gate 66 seals the interior of the vacuum chamber from the interior of the furnace). An outer gate 72 is provided for sealingly closing the outer opening of the vacuum chamber (when charge opening gate 66 is open). Thus, the crucible can be charged with fresh metal without having to release the vacuum inside the furnace 2. Vacuum source 18 (or another vacuum source if desired) is coupled to vacuum chamber 62 via vacuum valve 97 to remove air from the charge chamber after the outer gate 72 has been closed and before the inner gate 66 is opened for moving the metal container into the furnace. Backfilling the charge chamber with inert gas to match melt space pressure may be done prior to opening gate 66.

A mold 74 which has a mold cavity 76 of the desired shape is suitably supported in molding space 16 of the furnace and can be removed therefrom through an access opening 78 in the lower portion of the upright furnace wall. A mold withdrawal vacuum chamber 80 extends laterally from the access opening, and an inner door 82 sealingly separates the molding space from the interior of the vacuum chamber unless the door is in its opened position. The mold can be manually removed through the access opening or this is done with a mold removal drive 84 that is operatively coupled with the mold. The access opening leads to the interior of the vacuum chamber and the mold can be withdrawn past an open end of the chamber that can be sealingly closed with an outer door 88. The vacuum chamber is also coupled to vacuum source 18 via vacuum valve 98, and the operation of the doors and the mold removal drive is synchronized so that the mold can be removed from the molding section of the furnace without having to break the vacuum therein in a manner analogous to the manner in which the vacuum chamber 62 is operated.

Finally, to prevent an overheating of the crucible and closure plate 32, both are cooled, preferably with water that flows through appropriately arranged cooling ducts 90 and 92 in the crucible and the plate, respectively.

In use, closure plate 32 is moved into its closed position, so that boss 38 extends into drain hole 30, and a relatively small quantity of the metal to be melted is placed into the furnace. Plasma torch 44 is energized to melt the metal in the furnace and form a small pool of the melted metal in the drain hole above the boss of the closure plate. This pool is permitted to solidify to form a drain plug 94 of the metal to be melted. The downwardly converging hole surface 78 prevents the solid plug from dropping through the drain hole.

Prior to the energization of the plasma torch, the interior of the furnace is filled with the gas that is appropriate for the planned treatment of the metal and the earlier discussed vacuum is applied. Upon energizing electrode 48 of the plasma torch, the electric discharge arc 52 is established, even though the distance between the electrode and the crucible base (capable of holding about 100 lbs. of metal) is relatively long, say about 8–16 inches, as was mentioned earlier, because of the prevailing high vacuum of between about 5% and 32% of atmospheric pressure.

Following the formation of drain plug 94, a charge of fresh metal is placed into the crucible with metal container 68 and the container is then retracted into vacuum chamber 62 and inner gate 66 is sealed. Torch operation is continued to melt the desired quantity of metal. Field coil 56 is maintained at an appropriate level of excitation to get the desired amount of stirring for effective melting.

Prior to the time to pour the melted metal into mold 74, the closure plate 32 is withdrawn from beneath the drain hole 30 and the pressure in the mold section may, if desired, be reduced using vacuum source 18. By either increasing the arc current or adjusting the field strength, the metal of plug 94 may be melted through. At that point the metal drains into the mold. Appropriate flow conduits (not shown) with or without flow diverters (not shown) are provided between the drain hole of the crucible and mold to assure an even metal flow and, for example, sequentially fill a plurality of molds that may be positioned in the molding space 16 of the furnace. After drainage is completed, the molds are removed from the furnace through vacuum chamber 80 (where they may be retained for a period of time to permit a cooling and freezing of the metal before it is exposed to the exterior atmosphere).

The melted metal in the crucible forms a thin, solidified layer of the metal 96, a so-called skull, that is in contact with the cooled interior crucible surfaces. The skull remains on the crucible walls after the melted metal has been drained. Upon insertion of the closure boss 38 into the drain hole, the boss engages the portion of the skull lining drain hole wall 28 and pushes it, including most or all of the portions of the skull overlying bottom surface 26 and side wall 24 of the crucible, in an upward direction a short distance "h", thereby separating the skull from the crucible surfaces. This enables easily melting the skull by reenergizing the plasma torch.

Since the skull is separated from the crucible surfaces, it melts quickly. The resulting melted metal flows into the closed drain hole, where it again forms a small pool of metal which, when sufficiently covered by additional metal, freezes into a new drain plug 94.

This not only greatly increases the frequency with which successive batches of metal can be melted and poured, it also saves operating costs. Little gas is lost from the interior of the furnace between batches since the only volume not retained within the furnace is a volume of gas entering the vacuum chambers. Accordingly, even when expensive inert treatment gases such as argon, for example, are used, the furnace can be economically operated because the overall consumption of gas is relatively small, thereby further contributing to the desired reduction in the cost of molding articles from specialty metals.

One particularly efficient embodiment of the invention is used for manufacturing metal parts, such as golf club heads, of substantially pure titanium or other specialty metals.

In spite of the relatively small size of the furnace of the present invention, relatively high production rates can be attained with it because the cycle time from one batch to the next is short. The interval between successive batches is no longer than the time needed to close the drain hole following the last pour, melt the raised skull to form a fresh drain plug, and recharge the furnace with a load of fresh metal.

Still further cost savings can be obtained, especially for relatively small production runs, since relatively pure titanium scrap can be purchased on the open market from others who use titanium melted, treated and poured into ingots in accordance with the prior art. The titanium scrap can be remelted in the furnace of the present invention. This significantly reduces the material cost per part as compared to prior art methods of fabricating titanium (or other metal) golf club heads from titanium (or other metal) ingots.

What is claimed is:

1. A method of melting metal in a furnace having an open enclosure, a cover closing the enclosure, a crucible within the enclosure having a bottom with a drain hole closed by a plug, and an electrode fixedly mounted to the enclosure for generating an electric discharge between the electrode and contents of the crucible, the method comprising the steps of: (a) initially forming a plug of the metal which closes the drain hole; (b) subjecting the enclosure to a vacuum in the range between about 5% and 32% of atmospheric pressure; (c) charging metal into the crucible; (d) with the electric discharge, melting metal in the crucible; (e) pouring the melted metal through the drain hole by concentrating the electric discharge over the plug until the plug is melted; (f) generating a skull of the metal on an inside surface of the crucible including a portion thereof which defines the drain hole; (g) separating at least a portion of the skull from the inside crucible surface; (h) closing the drain hole; (i) energizing the electrode to form an electric discharge melting at least a portion of the skull and thereafter cooling the portion of the melted metal to form another metal plug in the drain hole; (j) thereafter charging the crucible with another quantity of the metal; and (k) repeating steps (c) to (i).

2. A method according to claim 1 wherein the step of charging is performed while substantially maintaining the vacuum in the enclosure.

3. A method according to claim 2 wherein the step of pouring comprises the step of pouring the melted metal into a mold disposed within the enclosure, and removing the mold with the metal from the enclosure while maintaining the vacuum in the enclosure.

4. A method according to claim 3 including the steps of forming a mold and providing as the metal a metal consisting predominantly of a high performance metal.

5. A method according to claim 1 in which the electrode is hollow, liquid cooled, and located in a swirl flow plasma torch.

6. A method according to claim 1 in which the arc is initiated by lowering the chamber pressure to about 5% to 32% of atmospheric pressure.

7. A method according to claim 1 wherein the molten metal stirring is increased by the interaction of arc current with a supplemental coil generating a field with a substantial vertical component.

8. A method according to claim 1 including the step of separating the electrode from the bottom of the crucible by a distance of more than about two inches.

9. A method according to claim 8 wherein the distance is at least about 8 inches.

10. A method of casting parts of a relatively pure metal in a crucible having a bottom drain hole comprising the steps of (a) closing the drain hole with a plug of the metal; (b) subjecting the crucible to a vacuum in the range between about 5% and 32% of atmospheric pressure; (c) charging metal; (d) melting the metal in the crucible with a hot plasma flow; (e) providing a mold including a multiplicity of mold cavities, each cavity having a shape which substantially conforms to a desired shape of the desired part; (f) pouring the melted metal through the drain hole by concentrating the plasma flow over the plug until the plug has melted so that the melted metal flows from the drain hole into the cavities of the mold; (g) generating a skull of the metal on an inside surface of the crucible including a portion thereof which defines the drain hole; (h) separating at least the portion of the skull from the inside crucible surface; (i) closing the drain hole; (j) with the plasma flow, melting at least a portion of the skull separated from the crucible surface; (k) permitting the melted portion of the skull to collect in the drain hole and cooling the portion to form another metal plug in the drain hole; (l) solidifying the metal in the cavities to form solid metal part(s) and removing the solid metal part(s) from the cavities; (m) thereafter charging the crucible with another quantity of the relatively pure metal; (n) repeating steps (a) to (m); and (o) finishing a surface of the part(s) removed from the cavities.

11. A method according to claim 10 including the step of acquiring fresh substantially pure metal as scrap of such metal in the open market, and including the scrap as at least a portion of the relatively pure metal with which the crucible is being charged.

12. A method according to claim 11 wherein the substantially pure metal comprises one of substantially pure titanium, zirconium, niobium, hafnium, nickel, tantalum or tungsten, or any other metal where contamination by oxygen or nitrogen is a concern.

13. An apparatus for melting a specialty metal alloy comprising an enclosure; a vacuum source for generating a vacuum within the enclosure in the range between about 5% to 32% of atmospheric pressure; a crucible disposed within the enclosure forming an inner surface defining a melting chamber and a downwardly oriented drain hole; a plasma torch mounted to the enclosure for generating an electric discharge between the electrode and contents of the crucible and a hot plasma flow; means for charging the crucible with the metal so that, upon activation of the torch, the plasma flow melts the metal in the crucible and forms a melted metal pool therein and a skull on the inner surface of the crucible including a portion thereof defining the drain opening; and means operatively coupled with the crucible for closing the drain hole and separating at least a portion of the skull from the inside crucible surface so that the skull can be melted with the plasma flow to therewith form a plug which closes the drain hole upon cooling to permit the melting of another charge of metal.

14. Apparatus according to claim 13 including means for substantially immovably mounting the plasma torch on the enclosure.

15. Apparatus according to claim 13 wherein the closing means simultaneously closes the drain hole and separates at least the portion of the skull from the inner crucible surface.

16. Apparatus according to claim 15 wherein the closing means comprises a cooled metal plate having a boss adapted to extend into the discharge opening, and a drive for moving the plate parallel and transversely to an axis of the drain hole into a first position in which the boss extends into the drain hole and the plate closes the drain hole and a second position in which the plate is removed from the drain hole to permit the pouring of melted metal therethrough.

17. Apparatus according to claim 13 including means for charging the crucible with metal while the vacuum is maintained within the enclosure.

18. Apparatus according to claim 13 including a magnetic field generator for moving the metal in the molten pool.

19. Apparatus according to claim 13 including a mold positioned within the enclosure and beneath the drain hole for pouring of metal from the hole into the mold, and a drive for removing the mold from the enclosure.

20. Apparatus according to claim 19 wherein the drive permits removal of the mold from the enclosure while the enclosure is subjected to the vacuum.

21. Apparatus according to claim 19 wherein the mold comprises a mold having a cavity for giving the metal a shape of a finished part.

22. Apparatus according to claim 21 wherein the cavity has the shape of a golf club head.

23. Apparatus according to claim 13 wherein the crucible has a size for effectively holding no more than about 100 lbs. of the metal.

* * * * *